US005369874A

United States Patent [19]

McWilliams

[11] Patent Number: 5,369,874

[45] Date of Patent: Dec. 6, 1994

[54] METHOD OF MANUFACTURING A RADIANT ELECTRIC HEATER

[75] Inventor: Joseph A. McWilliams, Droitwich, United Kingdom

[73] Assignee: Ceramaspeed Limited, Droitwich, United Kingdom

[21] Appl. No.: 192,989

[22] Filed: Feb. 8, 1994

[30] Foreign Application Priority Data

Feb. 11, 1993 [GB] United Kingdom ..... 9302690

[51] Int. Cl.[5] ..... H05B 3/00

[52] U.S. Cl. ..... 29/611; 29/846; 29/848; 29/850; 219/459; 219/463; 219/467

[58] Field of Search ..... 29/611, 613, 846, 848, 29/850; 219/457–460, 463, 464, 467

[56] References Cited

U.S. PATENT DOCUMENTS

| | | | |
|---|---|---|---|
| 600,057 | 3/1898 | Ball | 338/280 |
| 2,145,564 | 1/1939 | Wiegand et al. | 219/463 |
| 3,612,829 | 10/1971 | Evans et al. | 219/464 |
| 3,991,298 | 11/1976 | Maake | 219/464 |
| 4,161,648 | 7/1979 | Göessler | 219/464 |
| 4,292,504 | 9/1981 | Gebarowski et al. | 219/542 |
| 4,347,432 | 8/1982 | Gössler | 219/457 |
| 4,388,520 | 6/1983 | McWilliams | 219/464 |

*Primary Examiner*—P. W. Echols
*Attorney, Agent, or Firm*—Ira S. Dorman

[57] ABSTRACT

A radiant electric heater is manufactured by a method which involves providing a base of microporous thermal and electrical insulation material having at least one groove formed in a surface thereof, and providing an elongate electrically conductive strip to serve as a heating element. The elongate electrically conductive strip is located edgewise into the groove and surface pressure is applied to the base of microporous insulation material in a region adjacent to the strip to deform the base and to urge microporous material of the base into contact with the strip so as to secure the strip in the groove.

13 Claims, 4 Drawing Sheets 4
h
5

2
9
1

A—A

METHOD OF MANUFACTURING A RADIANT ELECTRIC HEATER

This invention relates to a method of manufacturing a radiant electric heater and, more particularly but not exclusively, relates to a method of manufacturing a radiant electric heater for use with a glass-ceramic smooth top cooker.

BACKGROUND TO THE INVENTION

Radiant electric heaters are known in which an element of coiled bare electric resistance wire is supported on, and secured by staples to, a layer of microporous thermal and electrical insulating material compacted in a metal support dish. Such heaters are described, for example, in GB-A-1 580 909 and are incorporated in glass-ceramic smooth top cookers.

The term 'microporous' is used herein to identify porous or cellular materials in which the ultimate size of the cells or voids is less than the mean free path of an air molecule at NTP, i.e. of the order of 100 nm or smaller. A material which is microporous in this sense will exhibit very low transfer of heat by air conduction (that is collisions between air molecules). Such microporous materials include aerogel, which is a gel in which the liquid phase has been replaced by a gaseous phase in such a way as to avoid the shrinkage which would occur if the gel were dried directly from a liquid. A substantially identical structure can be obtained by controlled precipitation from solution, the temperature and pH being controlled during precipitation to obtain an open lattice precipitate. Other equivalent open lattice structures include pyrogenic (fumed) and electro-thermal types in which a substantial proportion of the particles have an ultimate particle size less than 100 nm. Any of these particulate materials, based for example on silica, alumina or other metal oxides, may be used to prepare a composition which is microporous as defined above.

The microporous insulation typically comprises a dry particulate microporous material as defined hereinabove mixed with ceramic fibre reinforcement, titanium dioxide opacifier and, for high temperature use, a small quantity of alumina powder to resist shrinkage. Such insulation material is described in GB-A-1 580 909.

Radiant electric heaters have also been proposed in which, instead of an element of coiled resistance wire, an element comprising an elongate electrically conductive strip of a metal or metal alloy is provided, the element being supported on edge on an insulating base. Arrangements of this kind are described, for example, in U.S. Pat. Nos. 600 057, 3,612,829, 3,991,298, 4,161,648 and 4,292,504. In U.S. Pat. No. 600,057, a conductor is mounted on a metal support, or in a groove formed therein, by means of a coating of insulating material such as a vitreous enamel. In U.S. Pat. No. 3,612,829, a convoluted conductive strip element in the form of a spiral is located in recesses pre-formed in the surface of a cast or moulded fibrous ceramic refractory material. Staples are used to secure the strip element to the supporting base. In U.S. Pat. No. 3,991,298, the conductive strip element is in the form of a spiral and is loose fitted in a pre-formed spiral groove in a rigid base of fire-resistant mortar.

In U.S. Pat. No. 4,161,648, a convoluted strip element of spiral form is provided with integral downwardly-extending mounting tabs which penetrate an electrically insulating sheet of high-temperature-withstanding board material and in the case of thin material may be bent over at the back of the material. The board-like insulating sheet with the element thereon is then located on top of a layer of microporous thermal insulation material in a supporting dish. In the case of a thick sheet of board material, a hardenable substance is used and is hardened after the tabs have been urged into the material.

In U.S. Pat. No. 4,292,504, a heating element in the form of a thin, foil-like strip of expanded metal is supported on edge substantially along its entire length in a serpentine groove formed in the upper surface of a ceramic fibreboard. The heating element is cemented or held by friction in the groove formed in the board.

OBJECT OF THE INVENTION

It is an object of the present invention to provide a method of manufacturing a radiant heater in which an elongate electrically conductive strip heater element is secured directly to a base of thermal and electrical insulation material without the need for mounting tabs or staples or any other additional securing means or process.

SUMMARY OF THE INVENTION

According to the present invention there is provided a method of manufacturing a radiant electric heater comprising the steps of: providing a base of microporous thermal and electrical insulation material having at least one groove formed in a surface thereof; providing an elongate electrically conductive strip to serve as a heating element; locating the elongate electrically conductive strip edgewise into the groove; and applying surface pressure to the base of microporous insulation material in a region adjacent to the strip to deform the base and to urge microporous material of the base into contact with the strip so as to secure the strip in the groove.

The surface pressure may be applied to cause controlled deformation of the base by effecting compaction of the microporous insulation material either at selected locations thereof, or over substantially the entire area thereof where the strip is located.

Application of the surface pressure is preferably effected at opposite sides of said strip, preferably substantially simultaneously.

The pressure may be applied manually or mechanically by means of one or more suitable press tools.

The groove may be formed of a depth selected according to the extent, if any, to which the strip after securement protrudes from the surface of the base of microporous insulation material.

The base of microporous insulation material is suitably provided as a compacted layer inside a supporting dish, suitably of metal.

The surface of the base of microporous insulation material in which the groove is provided is preferably substantially planar.

Preferably the said electrically conductive strip is of corrugated (also known as sinuous, serpentine or convoluted) form along its length.

The strip suitably comprises a metal or a metal alloy, such as an iron-chromium-aluminium alloy.

Suitable microporous thermal and electrical insulation materials are well-known in the art, for example as described in GB-A-1 580 909, a typical composition being:

| | |
|---|---|
| Microporous pyrogenic silica | 49 to 97% by weight |
| Ceramic fibre reinforcement | 0.5 to 20% by weight |
| Opacifier | 2 to 50% by weight |
| Alumina | up to 12% by weight |

The proportion of alumina is preferably in the range from 0.5 to 12 percent by weight.

The invention is now described by way of example with reference to the accompanying drawings in which:

DESCRIPTION OF PREFERRED EMBODIMENTS

A radiant electric heater is constructed comprising a metal dish 1 containing a base layer 2 of compacted microporous thermal and electrical insulation material, having a substantially planar surface and having a composition such as that described in GB-A-1 580 909.

Figure 1:
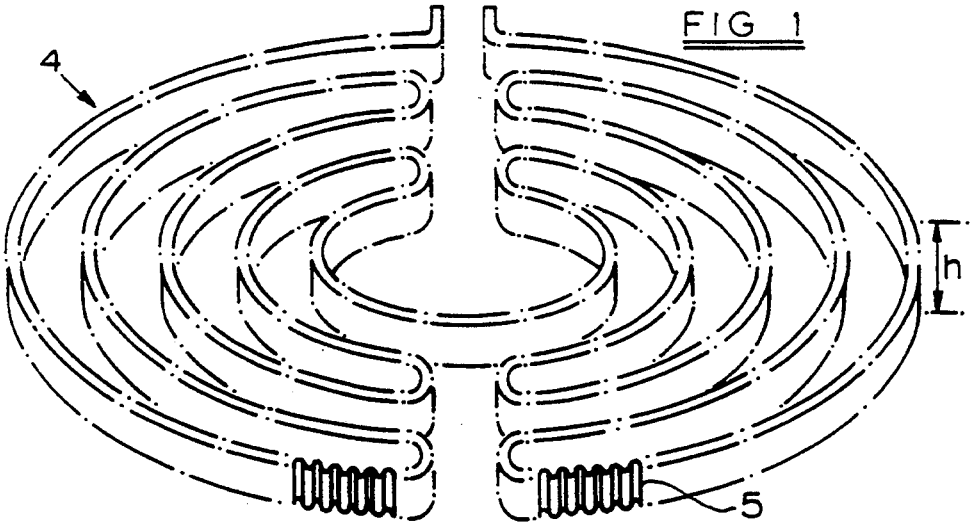
FIG. 1 is a perspective view of a heating element comprising an electrically conductive strip, for use in the manufacture of a radiant electric heater in accordance with the present invention.
Figure 2:
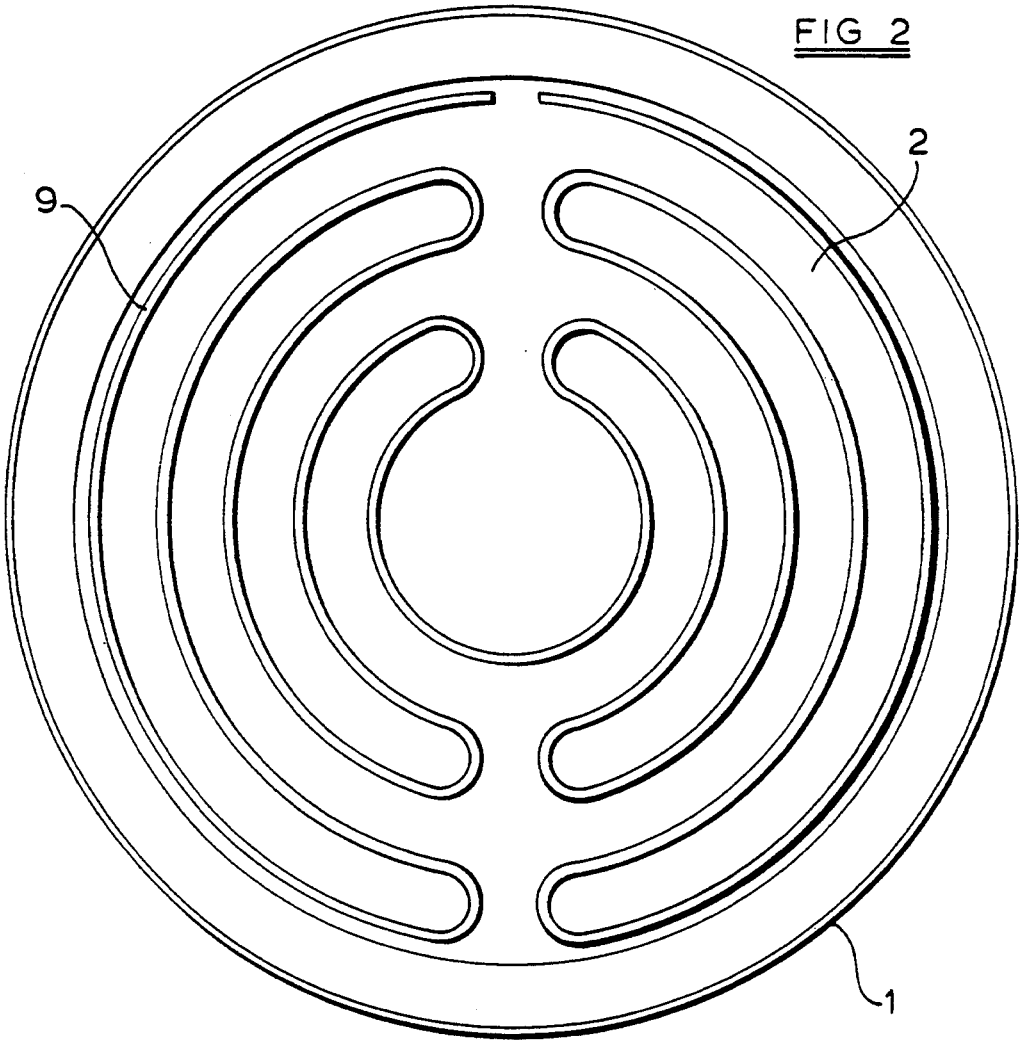
FIG. 2 is a plan view of a base for use in the manufacture of a radiant electric heater in accordance with the present invention, for receiving the heating element of FIG. 1.

A heating element 4 is provided from an elongate strip 5 of a metal or metal alloy, such as an iron-chromium-aluminium alloy, having a thickness of, for example, 0.05 to 0.2 mm and a height h of, for example, 3 to 6 mm. The strip 5 is itself provided of corrugated form (sometimes also known as sinuous, serpentine or convoluted form) and is bent into the desired shape for the heating element as shown in FIG. 1, using techniques well known in the art. It should be noted, however, that the dimensions of thickness of the strip quoted above are for the strip before making into corrugated form.

The surface of the base 2 of microporous insulation material is provided with grooves 9 in a pattern corresponding to the shape of the heating element 4. Such grooves 9 are suitably formed by means of an appropriate molding tool during compaction of the microporous insulation material into the dish 1 to form the base 2, or may be machined into the surface of the base material after compaction. The width of the grooves 9 is arranged to be at least as great as the overall width (i.e. the 'peak-to-peak' dimension) of the corrugated strip 5.

The heating element 4 is then located with the base 2 so that the strip 5 enters the matching grooves 9 edgewise. The depth of the grooves 9 is selected such that, when inserted therein, the strip 5 protrudes from the base 2 to a required extent, such as, for example, 50 percent or more of the height h of the strip 5.

Figure 4:
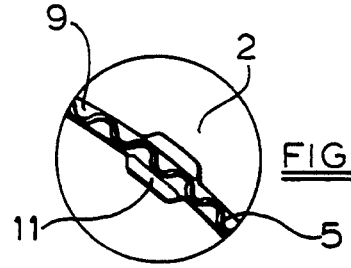
FIG. 4 is a view of part IV of FIG. 3 on a larger scale.
Figure 3:
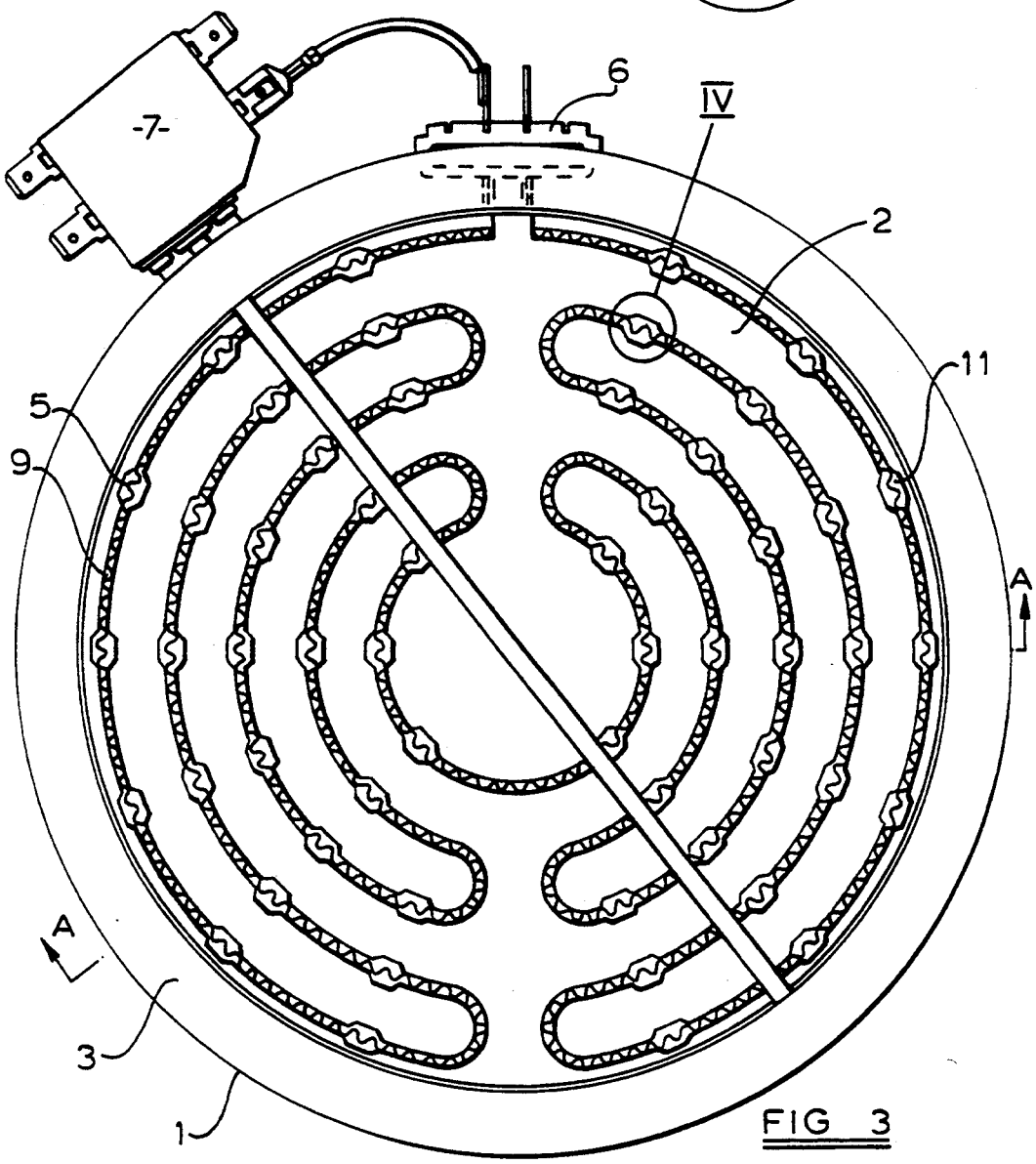
FIG. 3 is a plan view of a radiant electric heater manufactured in accordance with the present invention, comprising the components of FIGS. 1 and 2.
Figure 6:
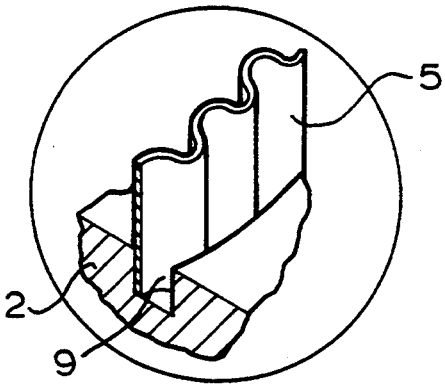
FIG. 6 is a view of part VI of FIG. 5 on a larger scale.
Figure 5:
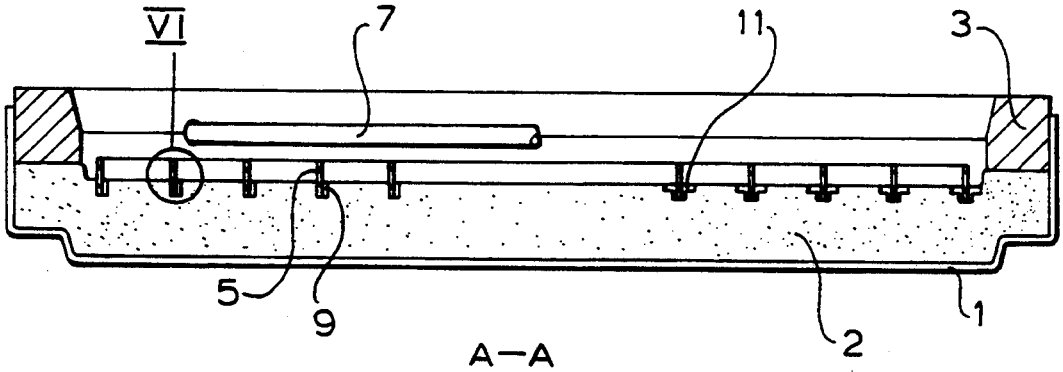
FIG. 5 is a cross-sectional view of the radiant electric heater of FIG. 3.
Figure 7:
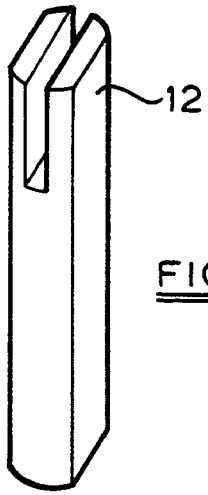
FIG. 7 is a perspective view of one embodiment of a metal rod for applying surface pressure to the base of microporous insulation material.
Figure 8:
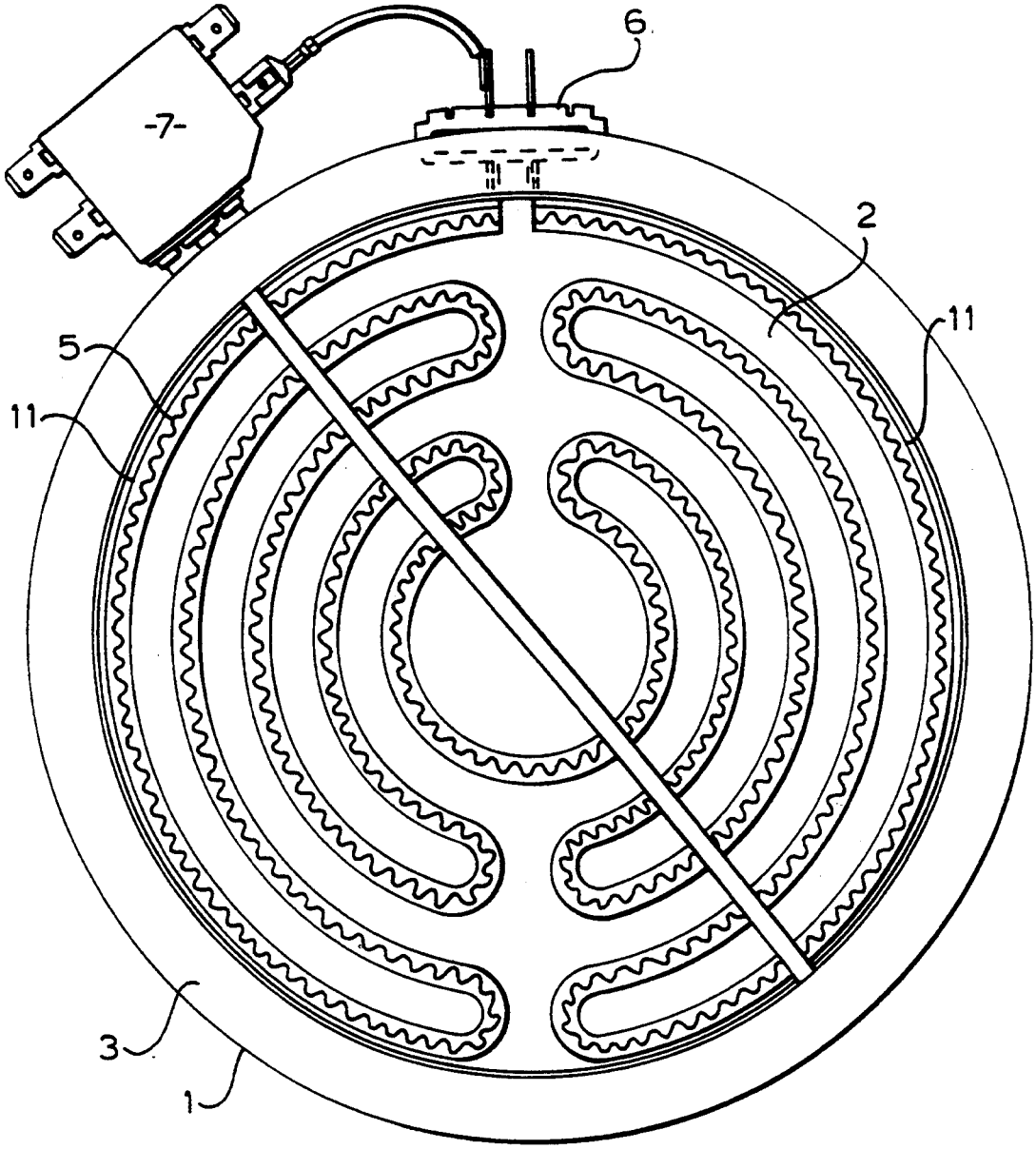
FIG. 8 is a plan view of another radiant heater manufactured in accordance with the present invention.

In order to secure the strip 5 in the grooves 9, controlled pressure is applied locally to the surface of the base 2 in regions 11 adjacent to the strip, on opposite sides thereof, to deform the base by compacting the microporous material and urging the material into contact with the strip 5. This is illustrated in FIG. 3 and, in more detail, in FIG. 4 which shows on a larger scale that part of FIG. 3 identified by the reference IV. One or more flat-ended metal rods, such as the rod 12 illustrated in FIG. 7, could be used to apply the necessary pressure, either manually or mechanically, and it may be preferable to apply pressure simultaneously at opposite sides of the strip. It will be apparent to the skilled person that a variety of techniques could be used to apply the necessary pressure, either locally (as shown in FIG. 3) or to the entire surface of the base 2 where the strip is located (as shown in FIG. 8).

Against the side of the dish 1 is located a peripheral wall 3 of thermal insulation material, such as a ceramic fibre material made from aluminosilicate fibres, or alternatively microporous insulation material.

A terminal connector 6 is provided for electrically connecting the heating element 4 to an electrical supply.

A well-known form of thermal cut-out device 7 is provided, extending over the heating element 4, to switch off the heating element in the event of over-heating of the glass-ceramic cooking surface when the heater is installed and operating in a cooking appliance having such a glass-ceramic cooking surface.

I claim:

1. A method of manufacturing a radiant electric heater comprising the steps of: providing a base of microporous thermal and electrical insulation material having at least one groove formed in a surface thereof; providing an elongate electrically conductive strip to serve as a heating element; locating the elongate electrically conductive strip edgewise into the groove; and applying surface pressure to the base of microporous insulation material in a region adjacent to the strip to deform the base and to urge microporous material of the base into contact with the strip so as to secure the strip in the groove.

2. A method according to claim 1, wherein the surface pressure is applied to cause controlled deformation of the base by effecting compaction of the microporous material at selected locations thereof.

3. A method according to claim 1, wherein the surface pressure is applied to cause controlled deformation of the base by effecting compaction of the microporous material over substantially the entire area thereof where the strip is located.

4. A method according to claim 1, wherein application of the pressure is effected at opposite sides of the strip.

5. A method according to claim 4, wherein application of the pressure at opposite sides of the strip is effected substantially simultaneously.

6. A method according to claim 1, wherein the pressure is applied manually by means of one or more suitable press tools.

7. A method according to claim 1, wherein the pressure is applied mechanically by means of one or more suitable press tools.

8. A method according to claim 1, wherein the groove is formed of such a depth that the strip after securement protrudes from the surface of the base of microporous insulation material.

9. A method according to claim 1, wherein the base of microporous insulation material is provided as a compacted layer inside a supporting dish.

10. A method according to claim 1, wherein the surface of the base of microporous insulation material in which the groove is provided is substantially planar.

11. A method according to claim 1, wherein the electrically conductive strip is of corrugated form along its length.

12. A method according to claim 1, wherein the strip comprises a metal or a metal alloy.

13. A method according to claim 12, wherein the metal alloy comprises an iron-chromium-aluminium alloy.

* * * * *